United States Patent [19]

Mochizuki et al.

[11] Patent Number: 4,875,633

[45] Date of Patent: Oct. 24, 1989

[54] PAPER SPLICING DEVICE

[75] Inventors: Seiji Mochizuki, Hachiohji; Fumiyasu Kato, Fussa, both of Japan

[73] Assignee: Toppan Moore Company, Ltd., Tokyo, Japan

[21] Appl. No.: 174,610

[22] Filed: Mar. 29, 1988

[30] Foreign Application Priority Data

Mar. 31, 1987 [JP] Japan ..... 62-47829[U]

[51] Int. Cl.[4] ..... B65H 19/16

[52] U.S. Cl. ..... 242/58.3

[58] Field of Search ..... 242/58.1–58.5, 242/; 156/502, 504, 505, 506, 510

[56] References Cited

U.S. PATENT DOCUMENTS

| | | | |
|---|---|---|---|
| 3,326,486 | 6/1967 | Blessing | 242/58.3 |
| 3,355,120 | 11/1967 | Huck | 242/58.3 |
| 3,516,617 | 6/1970 | Haner et al. | 242/58.2 |
| 3,655,143 | 4/1972 | Wallis | 242/58.3 |
| 3,746,272 | 7/1973 | Rotolo | 156/504 X |
| 4,077,580 | 3/1978 | Lang et al. | 242/58.3 X |
| 4,177,960 | 12/1979 | Nakagawa | 156/504 X |
| 4,181,847 | 1/1980 | Buschmann | 242/58.3 X |
| 4,337,903 | 7/1982 | Kessler et al. | 242/58.2 X |
| 4,715,922 | 12/1987 | Hayashi et al. | 242/58.3 X |

*Primary Examiner*—John M. Jillions

*Attorney, Agent, or Firm*—Weingarten, Schurgin, Gagnebin & Hayes

[57] ABSTRACT

Here is provided a paper splicing device having a tuning mechanism, and this tuning mechanism is provided with a tuning control section for tuning a rotary peripheral speed of a second rotor rotating in contact with the peripheral surface of the succeeding paper roll to a rotary peripheral speed of a first rotor rotating in contact with the peripheral surface of the preceding paper roll. To tune the above rotary peripheral speed of the paper rolls, the paper splicing device of the present invention comprises a cut section, a reference position detecting section, a rotational quantity detecting section, and a cut command section.

2 Claims, 3 Drawing Sheets

PAPER SPLICING DEVICE

BACKGROUND OF THE INVENTION (1) Field of the Invention

The present invention relates to a paper splicing device for continuously splicing a paper sheet of a preceding paper roll to a paper sheet of the succeeding paper roll, without any interruption of operation such as printing, when the rest of the preceding paper roll is rotated at a high speed in order to feed the paper sheet to, for example, a printing machine is small.

(2) Description of the Prior Art

Conventional paper splicing devices can be classified into a first device in which a paper splicing treatment is achieved while the rotation of a preceding paper roll is stopped and a second device in which a paper splicing treatment is achieved while the preceding paper roll is rotated.

In the first device in which a paper splicing treatment is achieved while the rotation of a preceding paper roll is stopped, a great deal of the paper sheet must be prepared so as to feed the paper sheet without interrupting the operation of printing or the like, even while the rotation of the preceding paper roll is stopped. Therefore, an accumulator comprising a number of dancer rollers which are movable in upward and downward directions is provided. Furthermore, in the second device in which a paper splicing treatment is achieved while the preceding paper roll is rotated, rotation driving force is applied to shaft portions of the preceding and succeeding paper rolls. However, unless a peripheral speed of the succeeding paper roll is perfectly adjusted to tune to a paper delivery speed of the preceding paper roll, excessive tensile strength is applied to the paper after the splicing operation and finally breaks the paper on occasion, or alternatively excessive sag is given to the paper, so that print non-uniformity, wrinkles and the like tend to occur in the subsequent process using a printing machine and the like. Thus, the following manner has been usually taken: In order to tune the paper delivery speed of the preceding paper roll to the peripheral speed of the succeeding paper roll, a rotational frequency and a diameter of the rotary shaft of the preceding paper roll are measured by an optical technique to seek the paper delivery speed of the preceding paper roll, and a diameter of the paper roll is previously measured to seek a rotational speed of the succeeding paper roll.

In both the cases of the first and second devices, the paper of the preceding paper roll is cut after the paper splicing operation. However, if the spliced portion of the papers is long, jamming is liable to take place, and a plate and a bracket of the printing machine are damaged at times in the subsequent printing process, which brings about more intricate jamming in a further process. For this reason, it is desirable that the spliced portion of the paper is as small and constant as possible.

In the above-mentioned first conventional device, the accumulator is necessary as described hereinbefore, and so a large-scale paper splicing device taking a very large occupational area is required inconveniently.

In addition, with regard to the above-mentioned second conventional device, it is difficult to accurately detect a peripheral speed of the paper roll and it is also hard to tune advantageously the peripheral speed of the preceding paper roll to that of the succeeding paper roll, though this device is not so oversize.

Morever, since the preceding and succeeding paper rolls are rotated during the paper splicing operation, it is difficult to precisely carry out the paper splicing operation and the cutting operation. Particularly in the case of the cutting operation, time lag arises inevitably, since an air cylinder or the like is used in a driving mechanism of a knife, with the result that the adjustment of cut timing is difficult. This difficulty has been heretofore solved by constantly maintaining the paper delivery speed during printing, or alternatively by causing the paper delivery speed in the paper splicing step to differ from the paper feed speed during the printing step, constantly maintaining the paper delivery speed, and delaying a cut command signal by the use of a timer to adjust the cut timing. However, when the paper delivery speed must often be changed in compliance with a kind of paper, the number of colors and a kind of ink, the above-mentioned manner of constantly maintaining the paper delivery speed is not suitable.

OBJECT OF THE INVENTION

An object of the present invention is to provide a paper splicing device by which the advantage of the above-mentioned second conventional device can be kept up; peripheral speeds of the preceding and succeeding paper rolls can be tuned to each other; paper splicing can be carried out at a speed suitable for a printing operation; and a cut paper length after the paper splicing operation can be substantially constant.

SUMMARY OF THE INVENTION

A first aspect of the present invention is directed to a paper splicing device having a tuning mechanism for tuning a paper delivery speed of the succeeding paper roll to that of the preceding paper roll from which a paper is fed while rotated, whereby the start portion of the paper of the succeeding paper roll is stuck to the paper of the preceding paperroll, while peripheral speeds of both the paper rolls are tuned to each other, and the tuning mechanism is provided with a tuning control section for tuning a rotary peripheral speed of a second rotor rotating in contact with the peripheral surface of the succeeding paper roll to a rotary peripheral speed of a first rotor rotating in contact with the peripheral surface of the preceding paper roll.

A second aspect of the present invention is directed to a paper splicing device having a tuning mechanism for tuning a paper delivery speed of the succeeding paper roll to that of the preceding paper roll from which a paper is fed while rotated, whereby the start portion of the succeeding paper roll is stuck to the preceding paper roll, while peripheral speeds of both the paper rolls are tuned to each other, and the paper splicing device comprises a cut section for cutting the spliced paper of the preceding paper roll, a reference position detecting section for detecting a spliced tip position of the succeeding paper roll, a rotational quantity detecting section for detecting a rotational quantity of the proceeding paper roll, and a cut command section for giving a cut operation signal in accordance with a signal sent from the reference position detecting section, the aforesaid cut operation signal adjusting cut operation timing on the basis of a signal sent from the rotational quantity detecting section, whereby the cut operation signal is given so that the cut operation may be carried out when the paper tip portion of the proceeding paper roll has reached a cut position, in view of the rotational quantity of the succeeding paper roll for a period corresponding to a time lag of the cut operation in the cut section.

The cut operation signal is given on the basis of the rotational quantity of the succeeding paper roll to adjust the timing, and therefore the cut operation can be always performed on the timing corresponding to the rotational speed o the succeeding paper roll, which permits a length of the spliced paper to be substantially constant and short.

Moreover, since the rotary peripheral speeds of the respective rotors are identical with each other, the proceeding and succeeding paper rolls which are brought into contact with these rotors can have the same peripheral speeds.

DETAILED DESCRIPTION OF THE INVENTION

A suitable embodiment of the present invention will be described in reference to the accompanying drawings.

Figure 1:
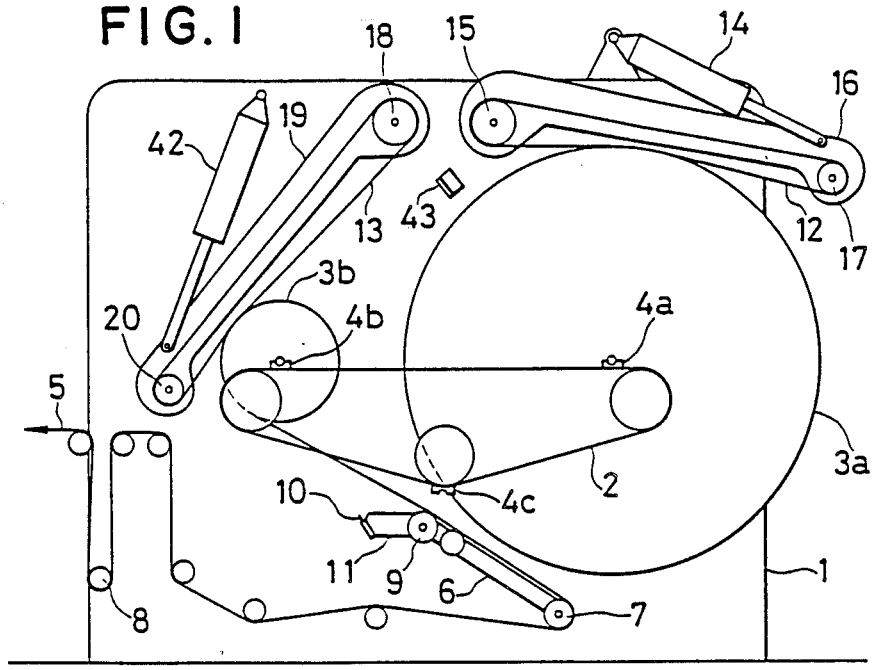
FIG. 1 is a side view illustrating the entirety of a device of the present invention.

In the first place, a constitution of a paper splicing device with regard to this embodiment will be described. In FIG. 1, a chain conveyor 2 is attached to a machine frame 1 so as to circularly move in a counterclockwise direction on this drawing. This chain conveyor 2 is provided with three bearings 4*a*, 4*b*, 4*c* (only one side of each of these bearings is shown) in a pair for rotatably supporting paper rolls 3*a*, 3*b* at the opposite ends thereof, these bearings being disposed at an equal interval. The position of the bearings 4*a* shown in FIG. 1 decides the position where the succeeding paper roll 3*a* is disposed, and the position of the bearings 4*b* is the position to which the preceding paper roll 3*b* is transferred in order that a paper of the succeeding paper roll 3*a* may be spliced to a paper of the preceding paper roll 3*b*. That is, the above-mentioned chain conveyor 2 is connected to a driving motor not shown, and the respective bearings 4*a*, 4*b*, 4*c* disposed on the chain conveyor 2 are circularly and intermittently rotated a certain distance in a counterclockwise direction on the drawing.

A paper 5 delivered from the paper roll 3*a* or 3*b* is traveled via a guide roller 7 mounted at the lower end of a paper splicing head 6 which is supported on the machine frame 1 so a to swing upward and downward on FIG. 1, and the paper 5 is further guided by a plurality of guide rollers and is led to a dancer roller 8 which is movable in upward and downward directions. Afterward, the paper 5 is fed to a printing machine or the like not shown via a plurality of guide rollers and tension rollers partially shown. The above-mentioned paper splicing head 6 is provided at the upper end thereof with a sticking roller 9 wrapped in sponge for pressing the paper 5 delivered from the preceding paper roll 3*b* against the succeeding paper roll 3*a*, and the sticking roller 9 is provided with an arm 11 so as to move in upward and downward directions on FIG. 1. The arm 11 is provided on the tip thereof with a knife 10 which is a cutting section for cutting the paper 5 delivered from the preceding paper roll 3*b* after the paper splicing operation.

Above the chain conveyor 2, there are disposed two driving belts 12, 13 having the identical endless structures which are rotors. These driving belts 12, 13 are brought into contact with peripheral surfaces of the respective paper rolls 3*a*, 3*b* which are rotatably supported via shafts by the bearings 4*a*, 4*b*, 4*c* at predetermined positions, in order to impart rotary driving force to these paper rolls 3*a*, 3*b*. The one belt 12 of the above-mentioned driving belts extends between a driving pulley 15 and a floating roller 17 which are rotatably mounted on a swing arm 16 supported on the machine frame 1 for movement in upward and downward directions on FIG. 1 by a cylinder 14. In general, the driving belt 12 is circularly moved in a counterclockwise direction on FIG. 1. The other driving belt 13 extends between a driving pulley 18 and a floating roller 20 which are rotatably mounted on a swing arm 19 supported on the machine frame 1 for movement in upward and downward directions on FIG. 1 by a cylinder 42. In general, the driving belt 12 is circularly moved in a counterclockwise direction on FIG. 1. In this case, the above-mentioned two driving pulleys 15 and 18 have the identical size, shape and structure.

Figure 2:
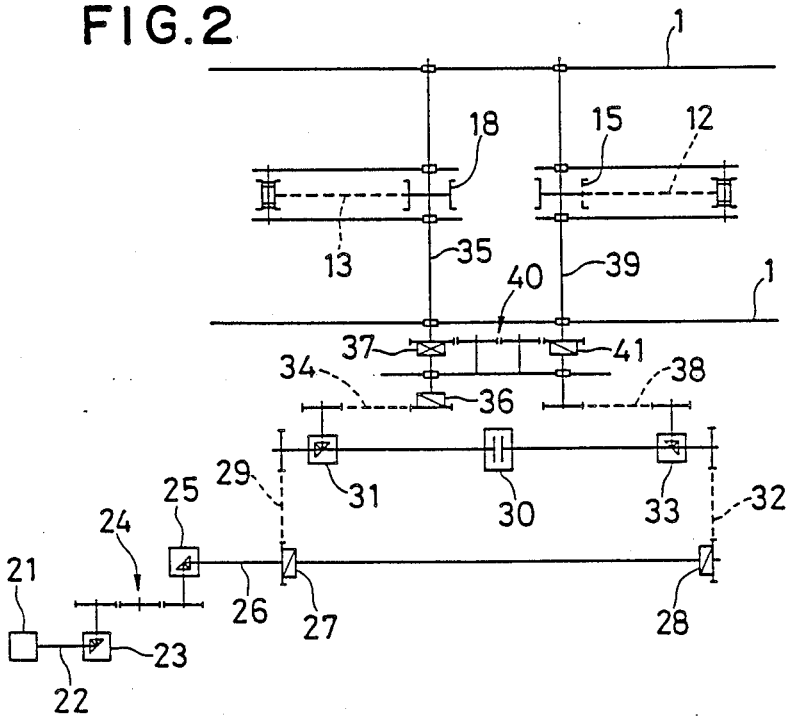
FIG. 2 is a schematic view illustrating a driving system for driving a rotor by which a paper roll is rotated.

Next, in accordance with FIG. 2, reference will be made to a driving system containing a tuning mechanism for driving the respective driving belts 12, 13.

A driving shaft 22 of a driving motor 21 is connected to a gear box 23, and the latter is further connected to another gear box 25 with the interposition of a paper delivery direction change gear row 24. A driven shaft 26 to which the gear box 25 is connected is provided with two electromagnetic clutches 27, 28 having the same structure. The one electromagnetic clutch 27 is connected to a gear box 31 connected via a timing belt 29 to an electromagnetic powder clutch 30 which is a tuning control section, and the other electromagnetic clutch 28 is connected to a gear box 33 connected via a timing belt 32 having the same structure as the above timing belt 29 to the electromagnetic powder clutch 30 in like manner. These electromagnetic clutches 27 and 28 are interlocked therebetween so that both of the clutches may not be in a connection state or a disconnection state simultaneously. The above-mentioned gear box 31 is connected through a timing belt 34 to a rotary shaft 35 of the driving pulley 18, and this rotary shaft 35 is provided with an electromagnetic clutch 36 for connecting and disconnecting the timing belt 34 to and from the rotary shaft 35 and an electromagnetic brake 37 for stopping the rotation of the rotary shaft 35. The above-mentioned gear box 33 is connected through a timing belt 38 to a rotary shaft 39 of the driving pulley 15, and this rotary shaft 39 is provided with an electromagnetic clutch 41 for connecting and disconnecting the rotary shaft 39 to and from the rotary shaft 35 via an intermediate gear row 40. The gear boxes 31 and 33, the timing belts 34 and 38 as well as the rotary shafts 35 and 39 have the same structure, respectively. Therefore, the driving belts 12 and 13 which are driven by the transmission of the rotary driving force of the driving motor 21 have the same circular motion speed.

Figure 5:
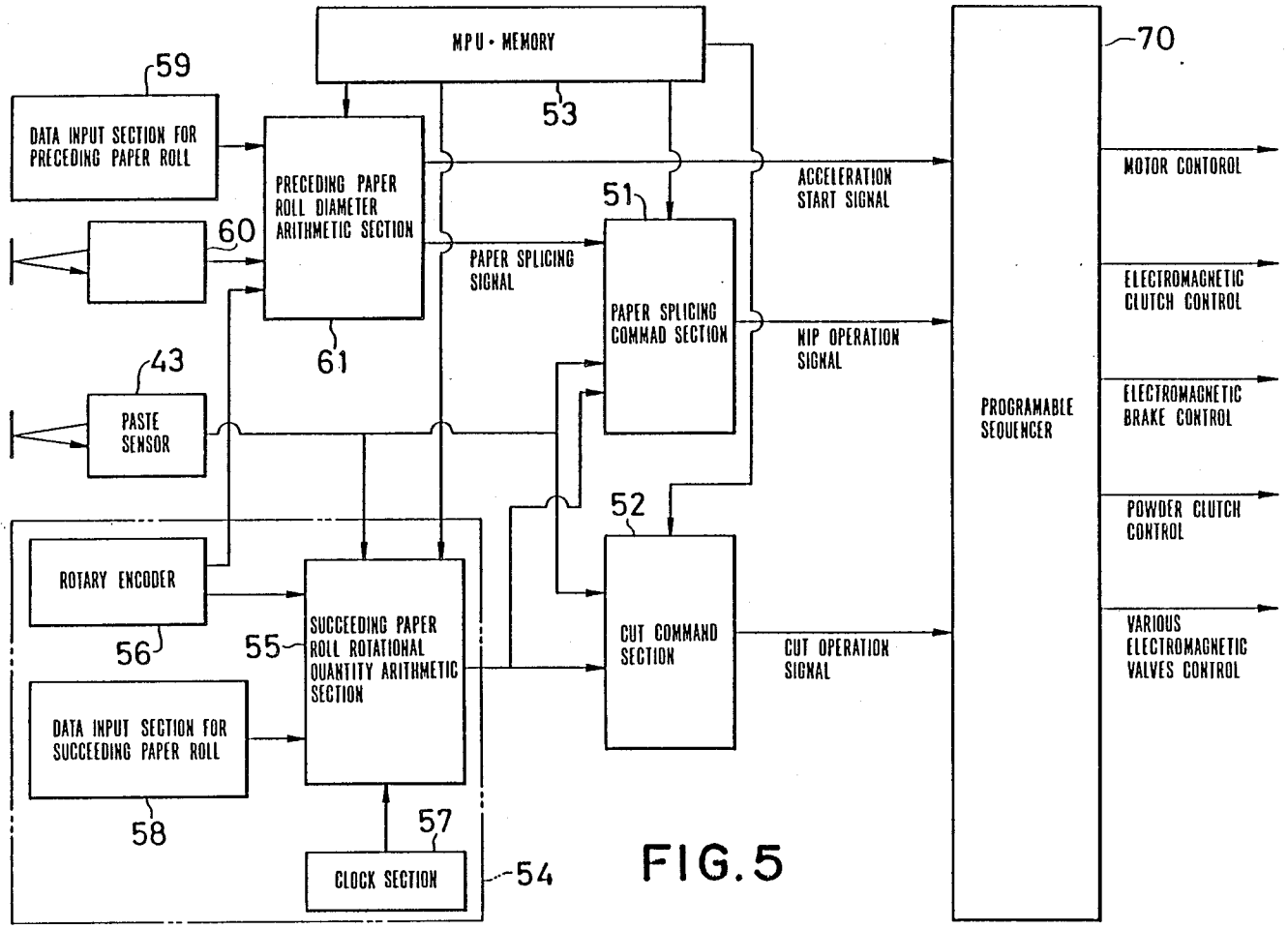
FIG. 5 is a block diagram illustrating an electrical signal system for controlling the paper splice and cut operation.

Now, in accordance with FIG. 5, reference will be made to an electrical control system for controlling a paper splicing operation and a paper cutting operation.

Figure 4:
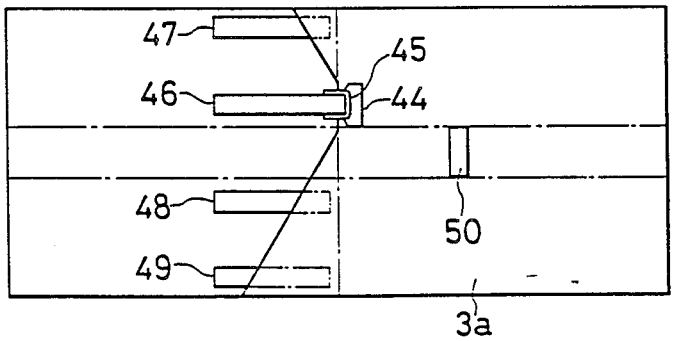
FIG. 4 is a plan view illustrating a waiting state of the succeeding paper roll.

A paste sensor 43 which is in a reference position detecting section is attached to the machine frame 1 so as to lie between the respective driving pulleys 15, 18 (see FIG. 1), and this paste sensor 43 detects a beginning portion of the paper for pasting from the presence of a silver tape 50 (see FIG. 4) on the beginning portion. A detecting signal outputted from the above-mentioned sensor 43 is inputted to a paper splicing command section 51, a cut command section 52 and a succeeding paper roll rotational quantity arithmetic section 55 in a rotational quantity detecting section 54 for detecting the rotational quantity of the succeeding paper roll. Control signals from a microprocessor unit (hereinafter referred to as MPU) are each inputted to the respective command sections 51 and 52, and a predetermined rotational quantity detecting signal from the succeeding paper roll rotational quantity arithmetic section 55 in the rotation number detecting section 54 is inputted to the cut command section 52. Moreover, to a programable sequencer 70 are inputted a nip operation signal for commanding the press operation of the sticking roller 9 from the paper splicing command section 51 and a cut operation signal for commanding the paper cut operation by the knife 10 from the cut command section 52. From the programable sequencer 70, control signals are outputted.

The rotational quantity detecting section 54 has a rotary encoder 56 for generating a reference pulse, for example, at an interval of 1 pulse per 0.1 inch of a paper feed, a clock section 57 for setting a time base equal to a cut operation time lag which is attributable to a mechanical driving mechanism of the knife 10, a succeeding paper roll data input section 58 for inputting a maximum pulse count which has been previously set in compliance with a diameter of the succeeding paper roll 3*a*, and the succeeding paper roll rotational quantity arithmetic section 55 to which the signals are inputted from the rotary encoder 56 and the sections 57 and 58 and to which the signals are inputted from MPU 53 and the paste sensor 43. A data signal and a gate signal are inputted to a preceding paper roll diameter arithmetic section 61 from a preceding paper roll data input section 59 for inputting a diameter value of the preceding paper roll 3*b* which decides an acceleration start time of the succeeding paper roll 3*a* and a start time of the paper splicing operation and from a preceding paper roll gate signal generating section 60 for generating one pulse signal per rotation of the preceding paper roll 3*b* and for outputting this pulse signal as the gate signal, respectively. In the preceding paper roll diameter arithmetic section 61, the diameter of the preceding paper roll 3*b* is calculated, and when the thus calculated value accords with the above-mentioned data signal, the acceleration start signal is inputted to the programable sequencer 70, and the paper splicing signal is inputted to the paper splicing command section 51. In addition, to the preceding paper roll diameter arithmetic section 61, signals are inputted from MPU 53 and the rotary encoder 56 in order to perform the above-mentioned arithmetic operation. In the succeeding paper roll rotational quantity arithmetic section 55, when a detection signal is generated from the paste sensor 43, the number of reference pulses per time base is counted. Furthermore, a difference between this count and the maximum pulse count is previously sought, and when a detection signal is generated from the paste sensor 43 at the time of the paper splicing operation, the number of the reference pulses are counted in like manner. When the thus counted number reaches the above-mentioned difference, a succeeding paper roll predetermined rotational quantity detecting signal is outputted. That is, when it is detected that the succeeding paper roll 3*a* has been moved forward as much as a rotational quantity rotated for a cut operation time lag of the knife 10 from a cut position, a succeeding paper roll predetermined rotational quantity detecting signal is outputted.

Next, reference will be made to a paper splicing operation in an embodiment constituted above together with a paper cutting operation.

Figure 3:
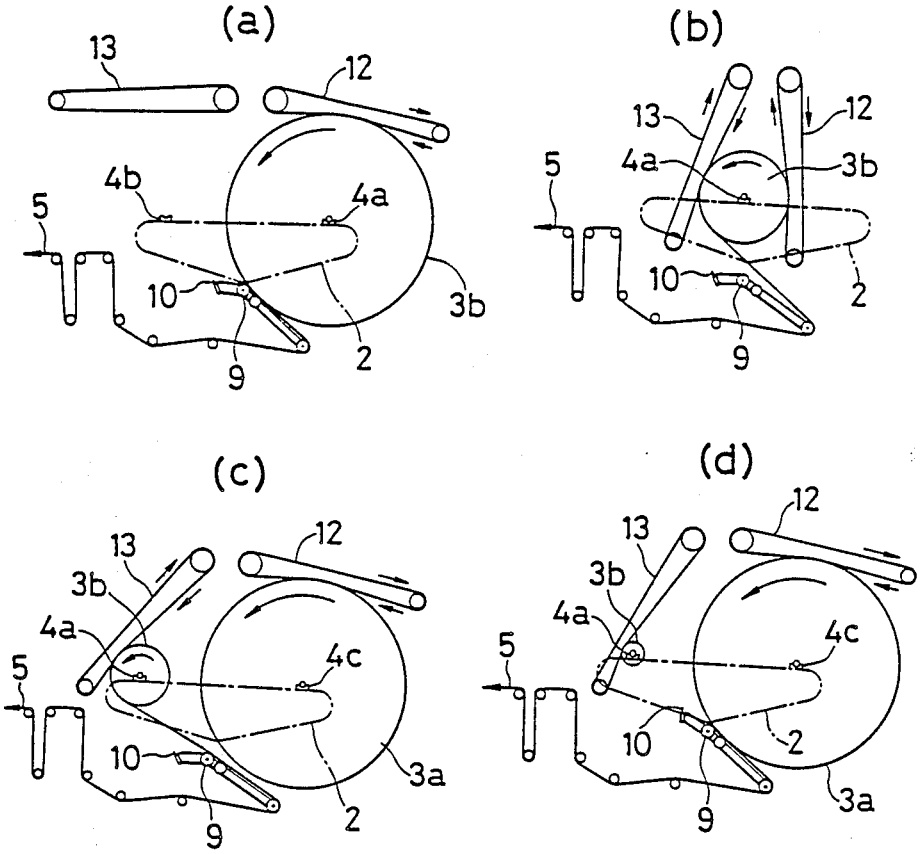
FIGS. 3(*a*) to 3(*d*) are schematic views explaining the operation of the device according to the present invention.

As shown in FIG. 3(*a*), the paper roll 3*b* supported by the shaft having the bearings 4*a* of the chain conveyor 2 is rotated in a counterclockwise direction on this drawing by the contact of the peripheral surface of the paper roll 3*b* with the driving belt 12 circularly moved in a normal direction, when the swing arm 16 is swung downward (see FIG. 1), whereby the paper 5 is continuously delivered at a high speed. In the driving system in this condition (see FIG. 2), the electromagnetic clutch 27 is connected, and a voltage to be applied to the electromagnetic powder clutch 30 is controlled so that 100% of transmission torque may arise. Thus, the driving belt 12 is continuously circularly moved and the paper delivery operation of the paper roll 3*b* is also continued, while the rotary motion of the driven shaft 26 is transmitted to the gear box 33 through the timing belt 29, the gear box 31 and the electromagnetic powder clutch 30, so that the driving pulley 15 is rotated via the timing belt 38 and the rotary shaft 39.

When the rest of the paper on the paper roll 3*b* is reduced to a predetermined amount or less, the preceding paper roll 3*b* is moved in a left direction on this drawing by the chain conveyor 2. Simultaneously with this movement, in the driving system, the electromagnetic clutch 36 is connected, and the rotary shaft 35 is also rotated via the timing belt 34. In addition, the driving belt 13 also begins to circularly move at the same speed as in the driving belt 12 in a normal direction. When the driving belt 13 is swingingly moved downward together with the swing arm 19 (see FIG. 1) and consequently driving force given by the driving belt 13 is transmitted to the paper roll 3*b*, the driving belt 12 is swingingly moved upward together with the swing arm 16, so that the belt 12 is separated from the paper roll 3*b*. At this time, in the driving system, the electromagnetic powder clutch 30 is disconnected, so that the rotation of the rotary shaft 39 is stopped and the driving belt 12 also comes to a stop. On the other hand, the movement of the paper roll 3*b* by the chain belt 2 is also stopped at a predetermined position [see the state of FIG. 3(*c*)].

In this state, the succeeding paper roll 3*a* is supported by the bearings 4*c* on the chain conveyor 2, and preparative operation for paper splicing is made. Next, this preparative operation will be described in reference to FIG. 4. In the first place, the end portion of the succeeding paper roll 3*a* is cut at right angles to the feed direction of the paper thereof, and an end fixing tab 44 is stuck on a portion of the succeeding paper roll 3*a*, deviating from a portion with which the driving belts 12, 13 will be brought into contact. Afterward, a double-coated tape 46 having a length of about 20 cm to about 25 cm is stuck on the paper of the paper roll 3*a* so that the rear edge of a double-coated tape 46 may be put immediately in front of a tab nick 45 of the end fixing tab 44, and three double-coated tapes 47, 48, 49 which are identical with the above-mentioned double-coated tape 46 are stuck at positions, on the paper of the succeeding paper roll 3*a*, deviating from the portions with which the driving belts 12, 13 will be brought into contact. After the respective double-coated tapes 46, 47, 48, 49 have been thus stuck on the paper, the latter is cut obliquely at an angle of about 30 degrees to a vertical line from both the front corners of the end fixing tab 44. Then, the silver tape 50 which will be detected to confirm the paste position is stuck longitudinally at the central position on the paper. Next, release papers (not shown) of the double-coated tapes 46, 47, 48, 49 are peeled therefrom, so that adhesive surfaces are exposed on these tapes and stickable condition is given on the paper, thereby getting over the preparative operation for the paper splicing operation.

The succeeding paper roll 3*a* which has been prepared in the above way is kept in this adhesive condition until the diameter of the preceding paper roll 3*b* has reached a predetermined level at which the paper splicing operation should be commenced. In this waiting period, when it is detected by the preceding paper roll diameter arithmetic section 61 that the diameter of the preceding paper roll 3*b* has accorded with a previously inputted diameter value of the preceding paper roll 3*b* at the time of the commencement of acceleration, an acceleration start signal is generated, so that a control signal is outputted from the programable sequencer 70. As a result, the driving belt 12 is swingingly moved downward again together with the swing arm 16 in order to be brought into contact with the peripheral surface of the succeeding paper roll 3*a*. On the other hand, in the driving system, the electromagnetic powder clutch 30 is connected again, and a voltage to be applied is controlled so that the transmission torque may be increased gradually from 0 to 100% over about 10 seconds. In consequence, the succeeding paper roll 3*a* is accelerated gradually from its stop condition, and after about 10 seconds, the succeeding paper roll 3*a* is rotated at the same peripheral speed as in the preceding paper roll 3*b*.

At this point of time, the detecting signal outputted from the paste sensor 43 is inputted to the cut command section 52 and the succeeding paper roll rotational quantity arithmetic section 55, and in the succeeding paper roll rotational quantity arithmetic section 55, calculation is performed to seek a difference between a maximum pulse number and a reference pulse number counted in the time base.

It is detected in the preceding paper roll diameter arithmetic section 61 that the preceding paper roll 3*b* has reached a predetermined diameter at which the paper splicing operation should be commenced, and a paper splicing signal is outputted from the diameter arithmetic section 61. When the paste sensor 43 detects the first silver plate 50, the rotational quantity of the succeeding paper roll 3*a* is counted in the succeeding rotational quantity arithmetic section 55, and a nip operation signal is outputted from the paper splicing command section 51 at the position where the silver tape 50 passes through the sticking roller 9. After the paste position has been detected, the sticking roller 9 is displaced immediately after the paste position has passed through the sticking roller 9, and the paper 5 delivered from the preceding paper roll 3*b* is pressed against the peripheral surface of the succeeding paper roll 3*a*, thereby getting over the paper splicing operation. Next, after the second paste position has been detected and when the difference between pulse numbers which have been already calculated in the succeeding paper roll rotational quantity arithmetic section 55 is counted, a detecting signal is inputted to the cut command section 52. As a result, a cut signal is outputted from the cut command section 52, and thus a control signal is outputted from the programable sequencer 70 in order to operate the knife 10 when the paste position has reached the sticking roller 9 and the paper splicing operation has been completed, thereby cutting the paper 5 [see FIG. 3(*d*)]. At this time, in the driving system, the electromagnetic clutch 36 is disconnected simultaneously with the cutting operation of the knife 10, and on the other hand, the electromagnetic brake 37 is operated, thereby bringing the rotation of the rotary shaft 35 to a stop.

In succession, immediately after the electromagnetic brake 37 is switched off, the electromagnetic clutch 41 comes into the connecting state. Accordingly, the rotational force of the rotary shaft 39 is reversed via the intermediate gear row 40, and is then transmitted to the rotary shaft 35. Therefore, the used and unnecessary preceding paper roll 3*b* is rotated in a direction reverse to a normal direction by the driving belt 13, and the end portion of the preceding paper roll 3*b* is wound up. Afterward, the electromagnetic clutch 41 is disconnected, and the electromagnetic brake is operated again and the drive of the driving belt 13 is stopped. The driving belt 13 is then swung upward together with the swing arm 19 and is thus separated from the preceding paper roll 3*b*, thereby getting over one cycle of the paper splicing operation. In the case that the paper splicing operation is not carried out in the printing step, the driving belt 12 is only rotated in the driving system. In order to rotate this driving belt 12 alone, the electromagnetic clutch 28 is only connected, and all the other electromagnetic clutches 27, 36, 41, the electromagnetic powder clutch 30 and the electromagnetic brake 37 are disconnected. Then, the rotation driving force of the driving motor 21 is transmitted in turn to the driving shaft 22, the gear box 23, the gear row 24, the gear box 25, the driven shaft 26, the timing belt 32, the gear box 33 and the timing belt 38, so that the driving pulley 15 is rotated via the rotary shaft 39, and in consequence, the driving belt 12 alone is circularly moved. The employment of this manner permits durability of the driving system to be improved.

In this way, the above-mentioned serial paper splicing and cut operations are carried out under automatic control by means of the programable sequencer 70. Moreover, the used and unnecessary preceding paper roll 3*b* naturally falls, when the chain conveyor 2 is moved in the next paper splicing operation and the bearings 4*a* are inclined downward.

The present invention should not be limited to the embodiment described above. For example, as the rotor, the driving belts 12, 13 may be replaced with rotary rollers, and with regard to the driving system of the rotor, its constitution may be variously altered. Furthermore, the diameter of the succeeding paper roll 3*a* may be calculated from a delivery speed and a rotational speed of the paper instead of the manner of previously inputting this diameter. In addition, the rotational quantity of the succeeding paper roll 3*a* in the rotational quantity detecting section 54 may be detected on the basis of detecting signals which are generated when two sensors disposed at predetermined positions detect a certain position of the succeeding paper roll 3a.

As is apparent from the above description, according to the present invention, the smooth and reliable paper splicing operation can be achieved by tuning peripheral speeds of both the succeeding and preceding paper rolls to each other without making the device oversized. Moreover, even if the succeeding and preceding paper rolls do not have the identical peripheral speed, the paper splicing portion can have a short and substantially constant cut paper length.

What is claimed is:

1. A paper splicing device for splicing paper of a preceding to a succeeding paper roll having a tuning mechanism for tuning paper delivery speed of the succeeding paper roll to that of the preceding paper roll from which paper is fed while rotated, wherein a start portion of the paper of the succeeding paper roll is adhered to the paper of the preceding paper roll while peripheral speeds of said preceding and succeeding paper rolls are tuned to each other, said paper splicing device being characterized in that said timing mechanism is provided with connection means for connecting a first rotor rotating in contact with a peripheral surface of the preceding paper roll and a second rotor rotating in contact with a peripheral surface of the succeeding paper roll to a single driving source, said connection means transmitting a driving force to the first rotor from the driving source, and a tuning control section connected to the second rotor from a connection system by said connection means through an electromagnetic powder clutch capable of varying the driving so that a rotary peripheral speed of said second rotor rotating in contact with the peripheral surface of said succeeding paper roll can be gradually tuned to a rotary peripheral speed of said first rotor rotating in contact with the peripheral surface of said preceding paper roll.

2. A paper splicing device as defined in claim 1, comprising: a cut section for cutting the spliced paper of said preceding paper roll; a reference position detecting section for detecting a spliced tip position of said succeeding paper roll; a rotational quantity detecting section for detecting a rotational quantity pulse of said preceding paper roll; and a cut command section for giving a cut operation signal when the succeeding paper roll has detected a predetermined rotational quantity pulse preset in correspondence to a speed in accordance with a signal sent from said reference position detecting section, said cut operation signal adjusting cut operation timing on the basis of a rotational quantity pulse per predetermined time sent from said rotational quantity detecting section.

* * * * *

UNITED STATES PATENT AND TRADEMARK OFFICE

CERTIFICATE OF CORRECTION

PATENT NO. : 4,875,633

DATED : October 24, 1989

INVENTOR(S) : Seiji Mochizuki and Fumiyzsu Kato

It is certified that error appears in the above-identified patent and that said Letters Patent is hereby corrected as shown below:

In the Abstract, on line 8, "speed" should read --speeds--.

In Column 1, line 68, "tune advantageously" should read --advantageously tune--.
In Column 2, line 40, "paperroll" should read --paper roll--.
In Column 3, line 9, "speed o the" should read --speed of the--.
In Column 3, line 13, 14 "proceeding" should read --preceding--.
In Column 3. line 61,"so a to" should read --so as to--.

In Column 9, line 22, "timing" should read --tuning--.

Signed and Sealed this

Second Day of June, 1992

*Attest:*

DOUGLAS B. COMER

*Attesting Officer*

*Acting Commissioner of Patents and Trademarks*